US005241711A

United States Patent [19]

Badders

[11] Patent Number: 5,241,711

[45] Date of Patent: Sep. 7, 1993

[54] PRESSURIZED TOILET FLUSHING ASSEMBLY

[76] Inventor: Edwin T. Badders, P.O. Box 596, Pomona, Calif. 91769

[21] Appl. No.: 720,007

[22] Filed: Jun. 24, 1991

[51] Int. Cl.[5] ..... E03D 3/10; F16K 31/143

[52] U.S. Cl. ..... 4/359; 4/362; 251/33; 251/44; 251/63

[58] Field of Search ..... 4/378, 334, 354, 359, 4/361, 362; 251/33, 35, 44, 63

[56] References Cited

U.S. PATENT DOCUMENTS

| | | | |
|---|---|---|---|
| 870,000 | 11/1907 | Watrous | 251/33 |
| 880,594 | 3/1908 | Stickdorn | 4/359 |
| 1,027,819 | 5/1912 | Collin | 251/33 |
| 1,046,492 | 12/1912 | Ranson | 251/33 |
| 2,028,468 | 1/1936 | Murphy | 4/354 X |
| 2,321,743 | 6/1943 | Guibert et al. | 251/33 |
| 2,372,324 | 3/1945 | Hauser | 251/33 |
| 3,428,965 | 2/1969 | Achey | 4/359 |
| 3,628,195 | 12/1971 | Skousgaard | 4/354 |
| 3,677,294 | 7/1972 | Gibbs et al. | 4/354 X |
| 3,817,286 | 6/1974 | Caron et al. | 4/354 X |
| 4,060,857 | 12/1977 | Couton | 4/362 |
| 4,088,297 | 5/1978 | Doyle et al. | 251/33 |
| 4,143,433 | 3/1979 | Skousgaard | 4/362 x |
| 4,233,698 | 11/1980 | Martin | 4/354 |
| 5,005,226 | 4/1991 | Basile et al. | 4/354 |
| 5,046,201 | 9/1991 | Steinhardt et al. | 4/354 |

FOREIGN PATENT DOCUMENTS

| | | | |
|---|---|---|---|
| 0060693 | 8/1913 | Austria | 4/359 |
| 0505533 | 8/1930 | Fed. Rep. of Germany | 251/33 |
| 1090595 | 10/1960 | Fed. Rep. of Germany | 4/334 |
| 2901846 | 7/1980 | Fed. Rep. of Germany | 4/354 |
| 0497639 | 12/1919 | France | 251/33 |
| 0691502 | 10/1930 | France | 4/354 |
| 0797199 | 4/1936 | France | 4/359 |
| 0490972 | 2/1954 | Italy | 251/33 |
| 0617286 | 2/1961 | Italy | 251/33 |
| 0117515 | 11/1926 | Switzerland | 4/334 |
| 0601969 | 5/1948 | United Kingdom | 251/33 |

*Primary Examiner*—William A. Cuchlinski, Jr.
*Assistant Examiner*—John L. Beres
*Attorney, Agent, or Firm*—Lyon & Lyon

[57] ABSTRACT

A pressurized flushing assembly mounted in the tank of a toilet for providing a rapid and thorough flushing of the toilet bowl with a low volume of water. The assembly includes a water storage tank defining an outlet aperture communicating with the cistern drain and a valve assembly disposed within the storage tank for opening and closing the outlet aperture. The valve assembly communicates with a supply of pressurized water for directing water under pressure into the storage tank to compress the ambient air therein. The valve assembly includes a housing, a control valve, a fluid control piston, a cistern drain valve and a push button actuator for opening the control valve. Opening the control valve allows water within the valve assembly to flow therethrough and from the valve assembly, creating a pressure drop within the housing above the fluid control piston causing the fluid control piston rapidly to rise and allowing water to flow past the piston and from the valve assembly. The raising of the piston creates a pressure drop in the housing below the piston, causing the the cistern drain valve disposed therebelow rapidly to rise off the storage tank outlet aperture whereupon the compressed air within the storage tank drives the water therein through the tank's outlet aperture to effect a flushing of the toilet.

43 Claims, 4 Drawing Sheets

PRESSURIZED TOILET FLUSHING ASSEMBLY

BACKGROUND OF THE INVENTION

The present invention relates to a pressurized toilet flushing assembly which reduces water usage. Recent years have seen an increased public awareness of the need for water conservation. Because of their inefficiency and frequent use, toilets consume a substantial volume of water. The conventional home toilet is the static flush type which typically employs a flapper valve and relies on gravity to effect a flushing of the toilet bowl. Efforts to reduce toilet water usage have been ongoing for several years and have ranged from simply reducing the volume of water in the water tank with bricks or enclosed bags of water to the development of more efficient flushing mechanisms. While such developments have proved useful in conserving water, they have not met with widespread acceptance due to their increased costs, inadequate line carrying ability and limited water savings.

With many areas of the country experiencing drought conditions, ground water pollution and sewage clean-up problems, new building code standards are being enacted in many areas which limit toilet water usage in new construction to one 1.6 gallons, dead flush, i.e., each flush can only discharge 1.6 gallons of water down the cistern drain. In an effort to meet these requirements, manufacturers of static flush toilets have resorted to smaller bowls having a smaller water puddle and a reduced volume of water in the toilet tank. Such modifications have met with resistance in the marketplace because the bowls are not properly cleaned by the reduced flushed volume and because of the reduced line carrying capability of such toilets. To avoid these problems and still meet the 1.6 gallon dead flush standard, efforts have been made to utilize pressurized air to force a reduced volume of water far more rapidly into the toilet bowl than occurs with a gravity flush and thereby achieve a thorough flushing of the toilet bowl with less water. To achieve a thorough cleansing of the toilet bowl with such a mechanism without having to create a potentially hazardous pressure buildup within the toilet, it is necessary to maximize the effective utilization of the air pressure in the toilet flushing mechanism. The present invention achieves this goal.

SUMMARY OF THE INVENTION

Briefly, the toilet flushing mechanism of the present invention comprises a water storage tank adapted to be disposed within the ceramic toilet tank and a valve assembly carried by and disposed within the storage tank. The valve assembly is adapted to be continuously communicated with water under regulated line pressure for allowing incoming water to pass therethrough into the storage tank to effect partial filling of the storage tank and compression of the ambient air therein to the regulated line pressure. The valve assembly includes: a housing; a push button actuated control valve disposed in the upper portion of the housing for allowing water flow therethrough to a discharge line upon activation; a pressure responsive fluid control piston movable within the housing proximate the underside of the control valve between a closed position and an open position in response to hydraulic forces acting therein on; and a cistern drain value carried by the lower portion of the valve housing and moveable in response to hydraulic forces acting thereon from a lower sealing engagement with the cistern drain to a raised open position for allowing the comprised air within the storage tank to drive the stored water therein rapidly down the cistern drain to effect a thorough flushing of the toilet bowl.

Upon activation and opening of the control valve, the water under line pressure within the valve housing above the fluid control piston passes upwardly through the control valve which lowers the hydraulic pressure acting on the upper end of the fluid control piston. This drop in pressure causes the piston rapidly to rise to the open position allowing water to pass thereby, causing a drop in the hydraulic pressure above the cistern drain valve, whereupon the drain valve quickly rises and the water within the storage tank is driven by the compressed air therein rapidly through the cistern drain to the toilet bowl. A spring member is provided between the control valve and fluid flow piston to effect rapid closing of the control valve and immediate return of the fluid control piston to its closed position to reseal the upper portion of the valve housing and prevent further passage of water therethrough.

With the discharge of the stored water down the cistern drain, the pressure within the storage tank rapidly drops to atmospheric, allowing water under line pressure again to pass through the valve assembly to the storage tank for establishing the weir level within the toilet, refilling the storage tank and pressurizing the ambient air therein. A portion of the incoming water is directed into the valve housing above the cistern drain valve to force the cistern drain valve downwardly onto the cistern drain. As soon as sufficient water enters the tank to compress the air therein to line pressure, incoming flow ceases, completing the flushing cycle.

It is the principal object of the present invention to provide an improved water saving toilet flushing mechanism.

It is another object of the present invention to provide a pressurized toilet flushing assembly which effectively utilizes comprised air to drive water rapidly down the cistern drain to effect a thorough flushing of the toilet bowl with minimum water usage.

These and other objects and advantages of the present invention will become readily apparent from the following detailed description taken in conjunction with the accompanying drawings.

IN THE DRAWINGS

DESCRIPTION OF THE PREFERRED EMBODIMENT

Figure 1:
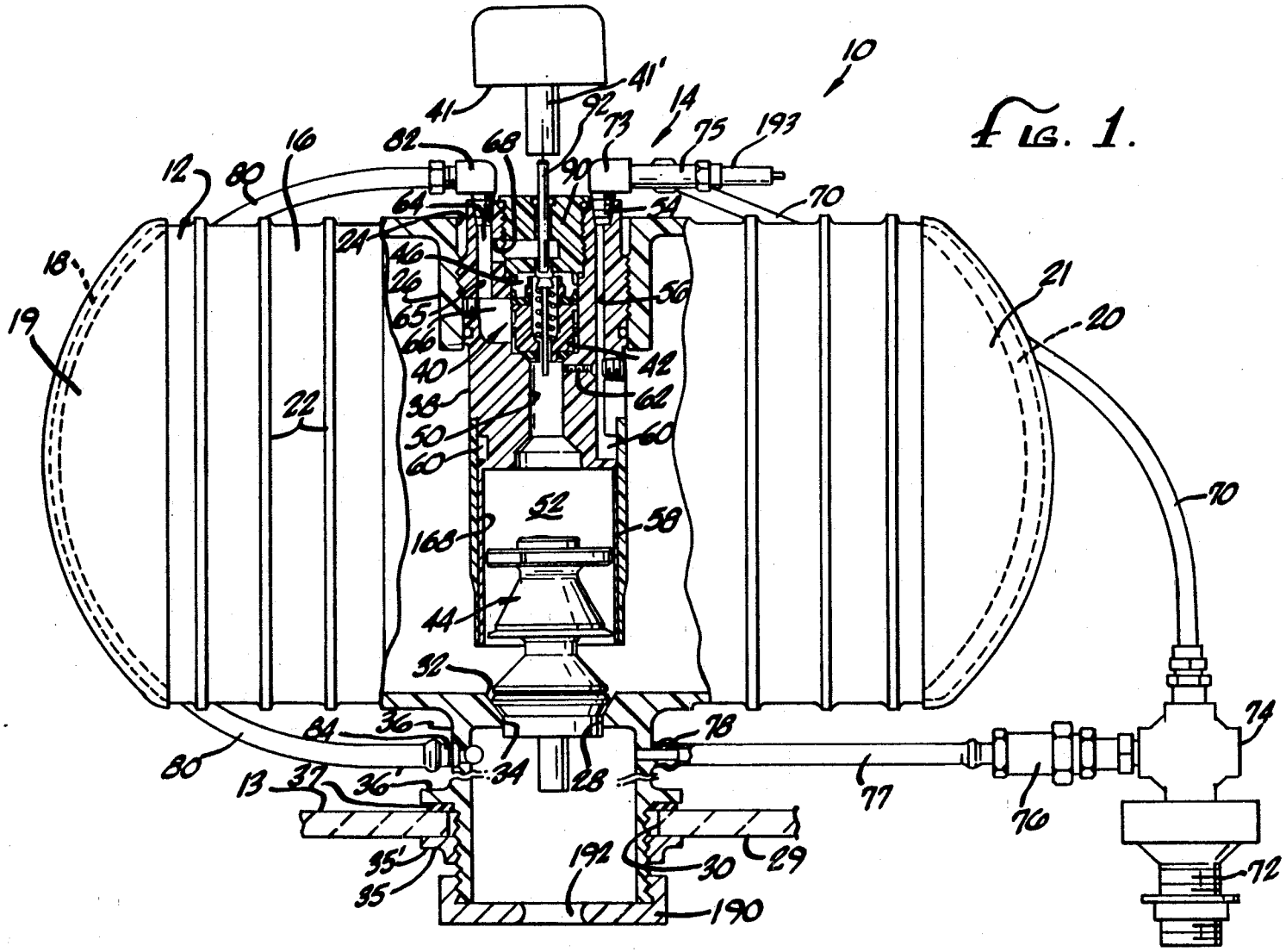
FIG. 1 is a sectional View of the toilet flushing assembly of the present invention.

Referring now in detail to the drawings, the pressurized toilet flushing assembly 10 of the present invention comprises a water storage tank 12 and a valve assembly 14 carried by and extending transversely through the interior of tank 12. Storage tank 12 is of a generally cylindrical configuration and is adapted to be mounted within the ceramic toilet tank 13 in a manner to be described. Tank 12 is preferably constructed of a high strength plastic material such as ABS plastic and is comprised of a cylindrical wall 16 terminating in convex end walls 18 and 20. Annular reinforcing ribs 22 are formed in cylindrical wall 16 to increase the structural integrity of the tank and, protective metal end caps 19 and 21 are disposed about the convex end walls 18 and 20 thereof. Storage tank 12 is sized to hold about 8 quarts of fluid therein. A circular opening 24 is provided in the upper end of tank wall 16 to receive the valve assembly 14 and a annular mounting flange 26 depends from the perimeter of opening 24 for the mounting thereon of valve assembly 14. A water outlet opening 28 is provided in the lower end of tank wall 16 in axial alignment with opening 24 for the discharge of water within the tank to the cistern drain 30 in the bottom wall 29 of the ceramic toilet tank 13 to effect flushing of the toilet bowl (not shown). The perimeter wall defining water outlet opening 28, defines an inwardly tapered valve seat 32 and cylindrical lower wall portion 34. A cylindrical extension 36 is integrally formed with tank wall 16 and projects downwardly from water outlet opening 28, spaced from the perimeter thereof for the mounting of the storage tank 12 within the ceramic tank 13 and directing the water discharged from the storage tank 12 to the cistern drain 30. The perimeter wall defining water outlet opening 28 defines an inwardly tapered upward portion 32 and cylindrical lower portion 34.

Figure 7:
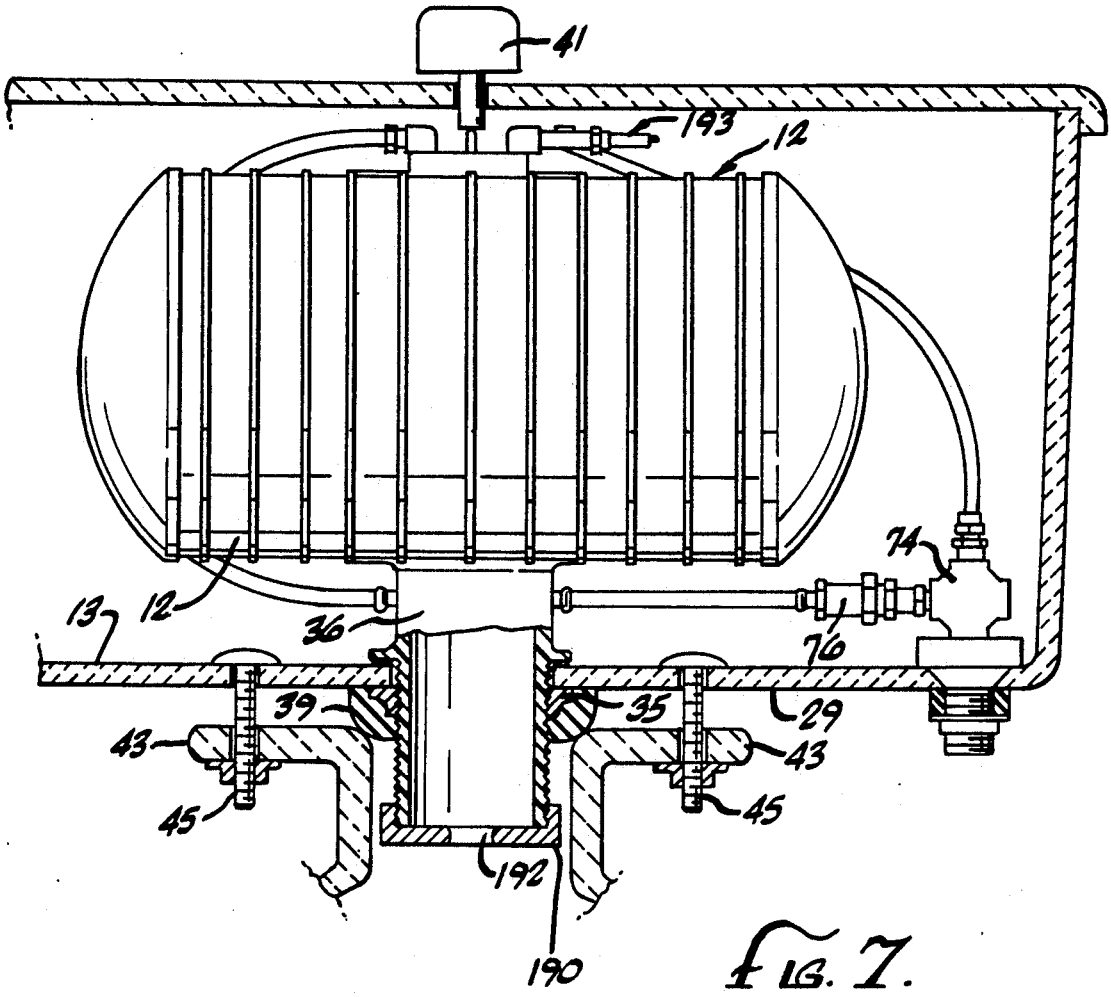
FIG. 7 is a sectional view of a ceramic toilet tank with the storage tank of the present invention installed.

As seen in FIG. 1, extension 36 on the storage tank 12 is provided with an annular radial flange 36' and projects into cistern drain 30. The storage tank 12 is secured in sealing engagement with the bottom wall 29 of toilet tank 13 by a threaded fastening nut 35 which threadably engages extension 36 and defines a radial flange 35' which bears against the underside of bottom wall 29 of ceramic tank 13. An upper sealing member 37 is disposed between extension flange 36' and the upper inner surface of wall 29. By tightening nut 35, the storage tank 12 is secured in place to the ceramic toilet tank 13. A soft rubber cup seal 39 is disposed about nut 35 and extension 36 and projects between the underside of the ceramic tank bottom wall 29 and the bowl mounting flange 43. Nut and bolt fasteners 45 are utilized to secure the ceramic toilet tank 13 in place in the conventional manner, with the storage tank 12 rigidly secured within tank 13 as seen in FIG. 7.

The valve assembly 14 comprises a generally cylindrical valve housing 38, a control valve 40 mounted in the upper end thereof, an actuating button 41, a fluid control piston 42 disposed proximate the lower end of the control valve 40 and a cistern drain valve 44 carried by the lower end of valve housing 38. The valve housing 38 is preferably constructed of a plastic material marketed under the trademark Delrin by E.I. du Pont de Nemours & Company and defines an upper cylindrical chamber 46 in which the control valve 40 and fluid control piston 42 are disposed, an intermediate chamber 50, and a lower chamber 52 for receiving the upper portion of cistern drain valve 44. A water inlet port 54 is provided in the upper end of valve housing 38 proximate one side thereof which communicates with a longitudinal inlet channel 56 formed in the side wall of the valve housing. Channel 56 is in fluid communication with a plurality of relatively flat longitudinally disposed tank fill slot 58 via an annular channel 60. A radial orifice 62 extends between inlet channel 56 and chamber 50. A water outlet port 64 is also provided in the upper end of the valve housing 38 on the opposite side thereof from inlet port 54. Outlet port 64 communicates with a longitudinal outlet channel 65 formed in the side wall of valve housing 38 which terminates in an enlarged opening 66 communicating with the lower portion of upper housing channel 46. An internal water outlet port 68 also communicating outlet channel 64 with chamber 46 is defined by the valve housing 38 above opening 66.

A water inlet line 70 communicates the inlet port 54 on the valve housing 38 with a standard water outlet line 72 provided in a building wall to direct a continuous supply of pressurized water to the valve housing. A brass elbow 73 is threadably engaged in inlet port 54 to secure line 70 thereto by means of a T-fitting 75. A conventional pressure regulator 74 is provided to limit the water pressure within inlet line 70 to about 35 psi to prevent an excess within the storage tank 12. As an additional safety precaution, a pressure relief valve 76 is provided in combination with pressure regulator 74 to direct the incoming water from the water outline 72 directly to the cistern drain 30 in the event of the failure of regulator 74. Pressure relief valve 76 communicates with the cistern drain 30 by means of line 77 which is in fluid communication with the cylindrical extension 36 on the underside of storage tank 14 by means of tubular extension 78. A water outlet line 80 communicates the water outlet port 64 on valve housing 38 with the cistern drain 30 by means of a brass elbow fitting 82 threadably engage in outlet port 62 and a second tubular extension 84 provided in cylindrical extension 36 on the opposite side thereof from extension 78.

Figure 2:
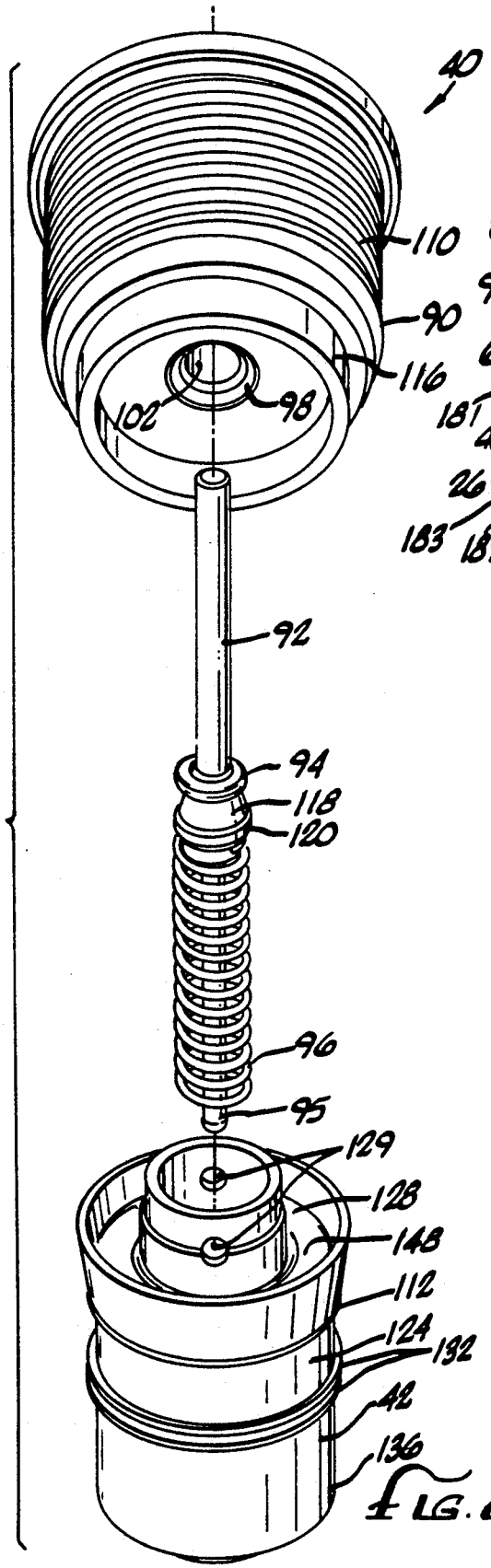
FIG. 2 is an exploded perspective view of the control valve support, control valve and fluid control piston of the present invention.

The control valve 40 and fluid control piston 42 which are mounted in the upper housing chamber 46 of valve housing 38 are illustrated in FIGS. 1 and 2. Control valve 40 comprises a cylindrical guide member 90 which is threadably mounted in the upper end of chamber 46, a control rod 92, an annular sealing member 94 carried by control rod 92, an orifice pin 95 extending axially from control rod 92, a helical spring 96, disposed about the upper portion of the orifice pin, a tapered valve seat 98 defined by the underside of guide member 90 which is adapted to mate with sealing member 94 to prevent water flow therebetween and actuating button 41

Guide member 90 which is also preferably constructed of Delrin plastic defines a centrally disposed cylindrical channel 102 extending axially therethrough in which the control rod 92 is slidably disposed. A first O-ring seal 104 is disposed in a groove 106 in guide member 90 about the upper end of the channel 102 to prevent water leakage from channel 102. A second O-ring seal 107 is provided in an annular groove 108 disposed about guide member 90 between the external mounting threads 110 by which guide member 90 is secured in the upper end of valve housing 38 and an upper end flange 112 on guide member 90 to prevent water leakage between the valve housing and guide member. A radial channel 114 is provided in guide member 90 for communicating the central channel 102 therein with the outlet channel 64 in the side wall of the valve housing through internal water outlet port 68. Guide member 90 also defines an annular skirt portion 116 depending from the lower surface thereof in which tapered valve seat 98 is formed at the lower end of the central channel 102.

The annular sealing member 94 on control rod 92 which is adapted to abut in sealing engagement with valve seat 98 in the underside of guide member 90 is held in an annular recess in the control rod 92 adjacent a frustoconical stop member 118 integrally formed with control rod 92. Orifice pin 94 which is of a smaller diameter than control rod 92 projects into and is secured to stop member 118 in a secured fitment such that pin 94 extends downwardly from and in axial alignment with control rod 92. A spring retainer 120 is fixed to the orifice pin adjacent stop member 118 and a helical spring 96 having a load rate of 1.5 lbs is held in compression between retainer 120 and an interior surface 122 on the fluid control piston 42. In the preferred embodiment of the invention, the radial clearance between the control rod 92 and the cylindrical wall forming central channel 102 is about 0.060 in. so as to allow upward water flow therebetween into radial channel 114 and outlet channel 64 upon the sealing member 94 carried by control rod 92 being moved downwardly off the valve seat 98 as will be discussed later herein.

Figure 3:
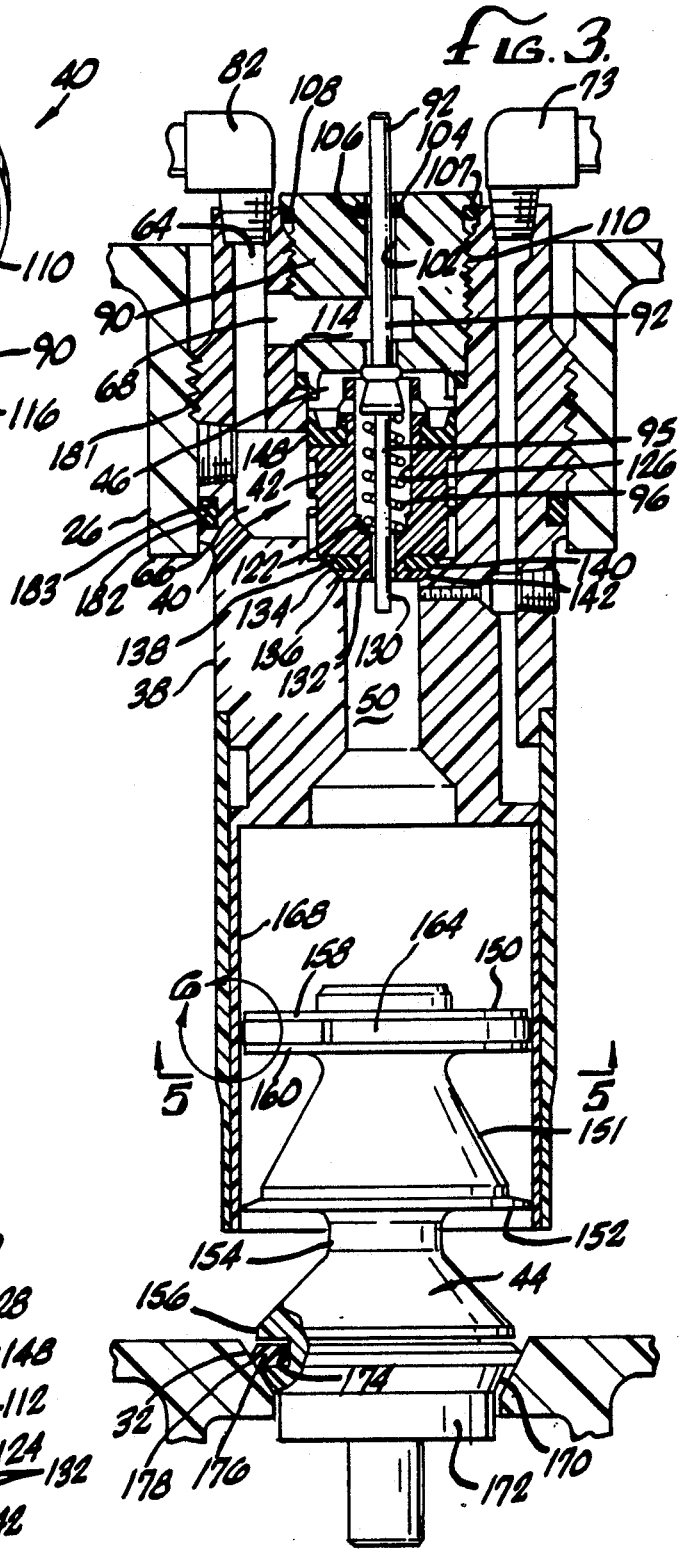
FIG. 3 is a cross section of the valve assembly of the present invention.
Figure 4:
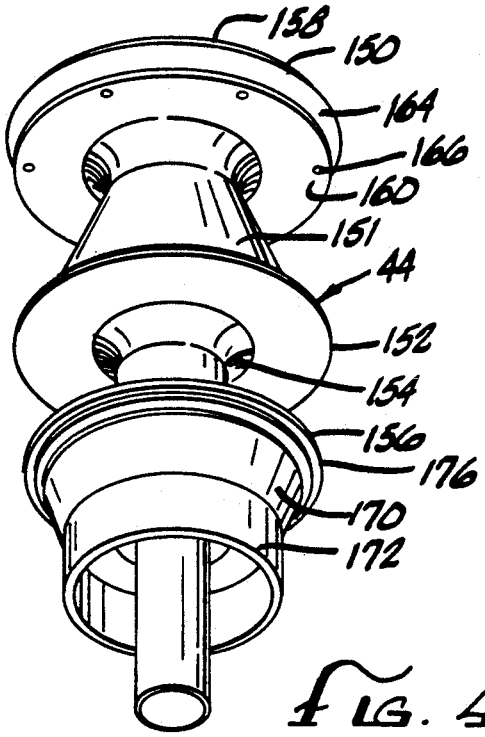
FIG. 4 is a perspective view of the system drain valve of the present invention.
Figure 5:
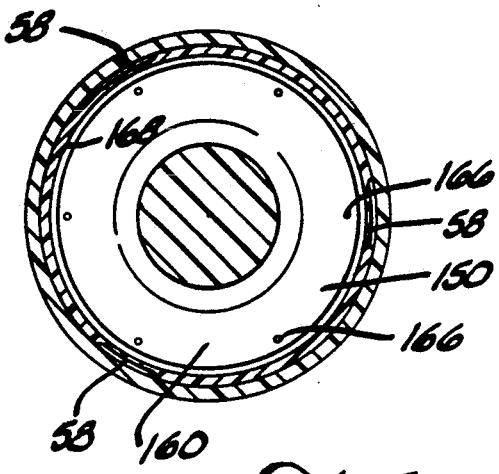
FIG. 5 is a sectional view taken along line 5—5 of FIG. 3.

The fluid control piston 42 also preferably constructed of Delrin plastic comprises a cylindrical body portion 124 defining an axially disposed chamber 126 therein and a tubular extension 128 projecting upwardly from chamber 126. A reduced diameter orifice 130 extends axially through the lower portion 132 of the piston and communicates with chamber 126. Orifice pin 94 of control valve 40 projects axially through chamber 126 and orifice 130. The helical spring 96 disposed about the upper portion of orifice pin 94 is positioned within a chamber 126 and extension 128 as seen in FIG. 3. Orifice 130 and orifice pin 94 are sized so as to provide a radial clearance of about 0.004–0.006 in. about therebetween to allow water flow through orifice 130 about pin 94. Orifice pin 94 is preferably constructed of a smaller diameter than control rod 92 to facilitate maintaining this smaller radial clearance during construction.

A pair of spaced lands 132 project radially from the body portion 124 of fluid control piston 42 which, together the upper end flange 112 maintains axial alignment of the piston 42 within the lower portion of upper housing chamber 46. An annular radial slot 134 is disposed in the tapered lower end 136 of the piston and an annular flat sealing member 138 is held within slot 134. The outer surface 140 of sealing member 138 defines a taper of about 45 degrees for sealing engagement with a correspondingly tapered the valve seat 142 defined by the valve housing 38 between the upper end of intermediate chamber 50 and lower end of chamber 46. An annular U-shaped cup lip seal 148 is disposed about and held against the tubular extension 128 so as to project axially upwardly from the piston body portion 124. Cup seal 148 defines an outer diameter which is greater than the diameter of the lower end 136 of the piston 42 so that the differential area forces acting on the fluid control piston 42 within valve housing 38 will force the piston to its lower closed position against valve seat 142 prior to the opening of the control valve 40. A plurality of spaced apertures 129 of about 1/16 inch in diameter are disposed in tubular extension 128 to allow a portion of the water passing upwardly through extension 128 upon the opening of control valve 40 to flow therethrough to the cup seal 148. Directing water flow through apertures 129 to the cup seal 148, more rapidly unbalances the fluid control piston upon the closing of the fluid control valve 40 to effect a more rapid lowering of the piston 42 as will be more fully set forth in the discussion of the operation of the flushing assembly 10.

Figure 6:
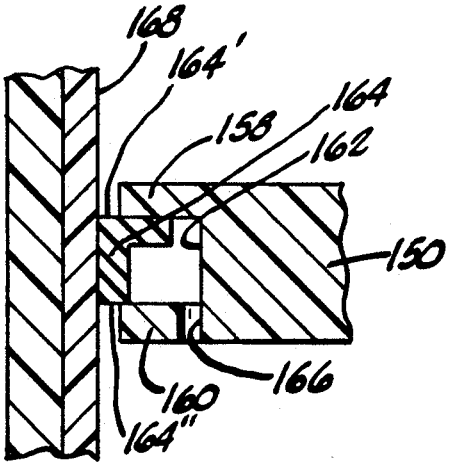
FIG. 6 is an enlarged sectional view taken along line 5—5 of FIG. 3 illustrating the configuration of the upper cistern drain valve seal.

The cistern drain valve 44 also preferably constructed of Delrin plastic is of integral construction and comprises an upper piston 150, an upper tapered body portion 151 extending from the underside of piston 150 to a lower piston 152, and a lower tapered body portion 154 extending from the underside of piston 152 to a valve head 156. Upper piston 150 defines a pair of spaced radial flanges 158 and 160 projecting from the perimeter thereof so as to define an annular recess 162 therebetween. A split sealing member 164 is disposed within groove 162. In the preferred embodiment of sealing member 164, illustrated in FIGS. 3 and 6, the sealing member is formed in two arcuate sections, 164' and 164" which substantially define an inverted "L" in cross section with the ends of sections 164' and 164" being spaced approximately 1/32 of an inch apart. A plurality of flow apertures 166 of about 1/16–⅛ inch in diameter are provided in the lower radial flange 160 inwardly of sealing member 164 to allow fluid flow therethrough upon an imbalancing of the pressure about piston 150 upon activation of the control valve 40 to force the sealing member sections 164' and 164" outwardly against the adjacent chamber wall 168.

The lower piston 152 on cistern drain valve 44 defines an outer diameter of preferably slightly less than the upper piston 150 and serves as an alignment guide for the cistern drain valve within chamber 52 of the valve housing 38. The underside of lower piston 152 also provides an additional lifting surface for valve 44 upon the opening of the control valve 40 and fluid control piston 42. The valve head 156 at the lower end of the cistern drain valve 44 defines an inwardly tapered surface 170, a depending skirt portion 172 and a horizontal radial slot 174 extending through surface 170. A flat annular sealing member 176 is disposed within a slot 174. The outer surface 178 of sealing member 176 extends parallel to and abuts the tapered valve seat 32 defined by storage tank 14 to form a seal therewith and prevent flow through the tank outlet opening 28. The inwardly tapered surface 170 of the valve head 156 is spaced inwardly from and extends parallel to valve seat 32 while the depending skirt portion 172 of valve head 156 projects through the lower portion 34 of water outlet opening 28.

With the exception of sealing member 164 which is preferably constructed of a non-swelling plastic material compatible with potable water such as ABS, O-rings 94, 104 and 107 and sealing members 138, 148 and 176 are preferably constructed of nitrile Buna—N rubber, seventy shore hardness. Control rod 92 and orifice pin 95 are preferably constructed of stainless steel. External threads 181 are provided on upper portion valve housing 38 for threaded engagement with the mounting flange 26 on storage tank 12. An O-ring 182, constructed of the same material as O-rings 94, 104 and 107 is disposed in an annular groove 183 in the external surface of valve housing 38 to prevent water leakage between the valve housing and mounting flange 26. As seen in FIG. 1, the upper end of control rod 92 extends upwardly from guide member 90 and is secured to actuating button 41. Actuating button 41 is located atop the ceramic toilet tank top for easy access and includes a stem portion 41' which extends through an aperture in the toilet tank top for engagement with the control rod 92.

Prior to actuation of the control valve 40, water under line pressure has passed from the standard outlet line 72 through the regulator 74 and into outlet line 70 at a regulated pressure of about 35 psi. While the flushing assembly 10 will operate satisfactorily at pressures as low as 20 psi, an operating pressure of about 35 psi provides superior line carrying ability. The incoming water enters the valve assembly 14 through inlet port 54, flows downwardly through channel 56 into annular channel 60 and into the storage tank 14 through fill slots 58 in the valve housing wall to fill the tank and compress the ambient air therein until the pressure within the tank equalizes at 35 psi. If a 1.6 gallon dead flush is desired, the tank is preferably sized to reach an internal pressure of 35 psi with the introduction of about one gallon of water into the interior thereof through the valve assembly 14. The remaining 0.6 gallon of water is carried by the toilet bowl.

A portion of the water passing through inlet channel 56 flows through orifice 62 into the intermediate chamber 50 in housing 38 and downwardly into the lower chamber 52. As water can flow about the upper and lower pistons 150 and 152 on the cistern drain valve 44, the incoming water will completely fill both chambers 50 and 52 in the valve housing. With the filling of chamber 50, water flows upwardly about orifice pin 95 through orifice 130 in the fluid control piston, filling chamber 126 therein and the upper chamber 46 in the valve housing above the cup seal 148 on the upper end of fluid control piston 42. Because the effective surface area defined by the upper end of the fluid control piston 42 is greater than the area defined by the lower end thereof, the resulting differential area forces force the fluid control piston 42 into its lower position in sealing engagement with valve seat 142. In this closed position, water is prevented from flowing about piston 42 to the outlet channel 64 through opening 66. The upper end of the cup seal 148 is spaced by a 1/16 of an inch from the lower edge of the skirt portion of the guide member 90. The force of the pressurized water within the upper housing chamber 46 acting on the annular sealing member 94 and the force of spring 96 hold the sealing member 94 against valve seat 98 on the underside of guide member 90 to maintain the fluid control valve 40 in the closed position. With the control valve 40, fluid control piston 42 and cistern drain valve 44 in their closed positions, the tank 12 is effectively sealed to maintain an internal equalized pressure throughout the tank equal to the incoming water pressure of 35 psi.

To initiate a flushing of the toilet bowl, one merely depresses the actuating button 41 which moves the control rod 92 downwardly, carrying sealing member 94 off of valve seat 98 and allowing the pressurized water in chamber 46 below valve seat 98 immediately to flow upwardly through channel 102 and guide member 90. The water flows about control rod 92 to radial channel 114, outlet channel 64 and into the outlet line 80 which carries the water to the cistern drain 30. As the water in channel 46 rapidly flows pass valve seat 98, the pressure above fluid control piston 42 immediately drops, unbalancing the piston and driving the piston upwardly against the depending skirt portion 116 of guide member 90, opening valve seat 142. Water within intermediate housing chamber 50 and lower housing chamber 52 then rushes through valve seat 142 about the fluid control piston 42, through opening 66 and outlet channel 64 to the outlet line 80.

As water rapidly evacuates the lower housing chamber 52, the pressure therein above upper piston 150 on the cistern drain valve 44 immediately drops, causing a pressure imbalance on the cistern drain valve which drives the valve 44 rapidly upwardly, off valve seat 32. The force of the compressed air within tank 12 then drives the water stored therein rapidly through the water outlet opening 28 in the bottom of tank 12 to effect a thorough flushing of the toilet bowl. By providing the valve head 156 on cistern drain valve 44 with a depending skirt portion 172, water flow is retarded for a fraction of a second, allowing the valve head 156 to completely clear the outlet opening 28 before water begins flowing therethrough to provide a more efficient flushing action.

Because of the flow apertures 166 in the lower flange 160 of cistern drain valve piston 150, as the pressure about the perimeter of piston 150 drops, water disposed below piston 150 passes through the flow apertures 166, pressing the two components 164' and 164" of sealing member 164 outwardly against the chamber wall 168. By pressing sealing member 164 against the chamber wall, any significant upward water flow about piston 150 is avoided thereby providing a very rapid upward movement of the cistern drain valve 44 within valve housing 38. The hydraulic forces acting on valve 44 are sufficiently large that the friction exerted by the plastic sealing member 164 against the chamber wall is easily overcome and does not inhibit the rapid upward movement of the cistern drain valve 44 within the valve housing 38.

As soon as the control valve 40 and fluid control piston 42 open, allowing water flow through valve seats 98 and 142 and raising the cistern drain valve 44, the resulting pressure drop within the upper portion of valve housing 38 allows the helical spring 96 to force the sealing member 94 on control rod 92 upwardly back into sealing engagement with valve seat 98 and the fluid control piston 42 downwardly into sealing engagement with valve seat 142, preventing further water flow to the outlet channel 64 and sealing the upper end of the valve assembly 14. As the water stored within tank 12 is driven through the water outlet opening 28 by the compressed air, the resulting pressure drop within the tank allows inlet water flow through inlet line 70 and inlet channel 56 to resume. The resulting flow through inlet channel 56 is directed both into the tank through fill slots 58 and into chamber 50 through orifice 62. The water flowing into chamber 50 through orifice 62 forces the cistern drain valve 44 back down into sealing engagement with valve seat 32, sealing the storage tank 12 so that it can be quickly refilled and the ambient air therein compressed until the internal pressure is again equalized at 35 psi whereupon the incoming will cease. As the pressure within the lower valve housing chamber 52 about cistern drain valve 44 drops upon the raising of valve 44 and the discharge of water from storage tank 12, the sealing member 164 is no longer pressed outwardly against chamber wall 168 so that the cistern drain valve 44 can be easily returned to its lower sealing position by the water passing through the orifice unimpeded by sealing member 164.

The rate at which the cistern drain valve 44 is forced downwardly to reseal the storage tank 14 is dependent on the volume of water passing through orifice 62 and thus on the size of orifice 62. Orifice 62 is sized such that it will allow sufficient water to pass therethrough to close the cistern drain valve 44 only after a sufficient volume of water has passed through the tank outlet opening 28 following the surge flush therethrough to enable the toilet bowl to the fill to the weir level. By varying the diameter of orifice 62, the assembly 10 of the present invention can be adjusted to operate properly with a wide variety of toilet bowl configurations and sizes.

Because of the high flushing velocity generated by the compressed air within storage tank 14, it is necessary in toilets having a relatively small bowl size to reduce the volume flow velocity to prevent water from spilling over the toilet rim. In toilets originally manufactured for use with a low volume pressurized water flush such as the Briggs Industries, Inc. Turboflush toilet, this is accomplished by forming two orifices in the ceramic toilet below the cistern drain in lieu of the standard large opening. One of the orifices is aligned to direct a portion of the pressurized water passing through the cistern drain 30 to the throat of the toilet bowl and trap seal while the second larger orifice directs water about the upper rim of the bowl to effect the desired swirling flush. In toilets such as the Briggs Turboflush, in which the bowl capacity is about 0.6 gallons, the smaller orifice is about ⅜ inch in diameter and the larger orifice is about ¾ inch in diameter. If the assembly 10 is used in a toilet having a relatively small bowl capacity which is not designed for a pressurized flush, a restrictor plate 190 (see FIG. 7) having a reduced diameter orifice 192 therein can be employed. The sizing of the orifice 190 would depend on the size and configuration of the toilet bowl with which the assembly 10 was to be utilized.

Figure 8:
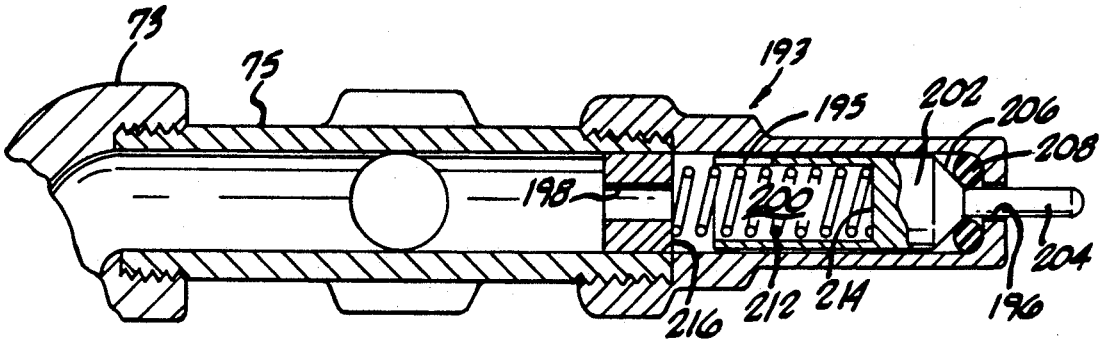
FIG. 8 is a sectional view taken along line 8—8 of FIG. 1.

To prevent siphoning of water from the assembly 10 in the event of a loss of upstream pressure in line 70, an anti-siphon valve 193 is secured to one end of the T-fitting 75 which is secured to elbow 73 to communicate valve 193 with the main valve assembly 14. Valve 193 is shown in FIG. 8 and includes a cylindrical housing 194 defining a first orifice 196 at one end thereof, a second orifice 198 in the opposite end thereof and a chamber 200 therebetween. A valve body 202 is disposed in chamber 200 for axial reciprocal movement therein. Valve body 202 carries a pin 204 which projects through orifice 196 and defines a tapered valve seat 206 which is adapted to abut an annular sealing member 208 carried by housing 194. The valve body 202 also defines a rear cavity 210 in which is disposed a coil spring 212 having a load rate of about 0.2 ounces. Spring 212 extends between the cavity wall 214 and inner surface 216 about orifice 198 and biases the valve body toward orifice 196 such that the valve seat 206 abuts sealing member 208 to prevent air flow therethrough. This sealing engagement is continuously maintained during normal use of assembly 10 by the pressure within the assembly 10 and by spring 212. In the event of total loss of line pressure which could occur if the upstream in water line were to break, the pressure downstream of valve 193 would drop to zero whereupon the resulting vacuum would draw the valve body inwardly, compressing spring 212, and causing air to pass through orifice 196 about pin 204 to relieve the vacuum and prevent any siphoning from assembly 10 back into line 70.

Various changes and modifications may be made in carrying out the present invention without the departing from the spirit and scope thereof. Insofar as these changes and modifications are within the purview of the appended claims, they are to be considered as part of the present invention.

I claim:

1. A flushing assembly adapted to be mounted in the tank of a toilet above the tank drain, said assembly comprising:

a water storage tank having ambient air therein and defining an upper end, a lower end and a water discharge outlet in said lower end;

means for directing water passing through said discharge outlet to the tank drain to effect a flushing of the toilet bowl;

a valve assembly disposed within said storage tank for opening and closing said discharge outlet;

a fluid inlet means for communicating said valve assembly with a supply of pressurized water;

fluid outlet means for communicating said valve assembly with the tank drain; and wherein said valve assembly comprises a valve housing disposed within said storage tank in axial alignment with said water discharge outlet, a first fluid flow means for directing water from said fluid inlet means into said storage tank to compress the ambient air within said storage tank, a second fluid flow means for directing water from said valve assembly to said fluid outlet means, a control valve mounted in said housing and including a control rod axially aligned with said water discharge outlet, a sealing member carried by said rod within said housing for closing and opening said second fluid flow means for selective passage of water therethrough to create and discharge a pressure differential within said housing, means for biasing said control valve to a closed position to prevent water flow through said second fluid flow means, and a drain valve axially aligned with said water discharge outlet in said tank and translatable into and out of sealing engagement with said supply tank discharge outlet in response to pressure differentials created within said housing by the closing and opening of said control valve.

2. A flushing assembly adapted to be mounted in the tank of a toilet above the tank drain, said assembly comprising:

a water storage tank having ambient air therein and defining a water discharge outlet;

means for directing water passing through said discharge outlet to the tank drain to effect a flushing of the toilet bowl;

a valve assembly disposed within said storage tank for opening and closing said discharge outlet;

a fluid inlet means for communicating said valve assembly with a supply of pressurized water;

fluid outlet means for communicating said valve assembly with the tank drain; and wherein said valve assembly comprises a valve housing, a first fluid flow means disposed in said housing for directing water from said fluid inlet means into said storage tank to compress the ambient air within said storage tank, a second fluid flows means disposed in said housing for directing water from said valve assembly to said fluid outlet means, a control valve disposed within said housing and including a control rod and a sealing member carried by said rod and moveable between a closed and open position for closing and opening said second fluid flow means for selective passage of water therethrough to create and relieve a pressure drop below said control valve, a third fluid flow means disposed within said housing below said second fluid flow means for directing water from said valve assembly to said fluid outlet means, a fluid control piston axially translatable within said housing below said control valve between a lower closed position preventing water flow to said third fluid flow means and an upper open position allowing water flow about said piston to said third fluid flow means in response to pressure differentials created thereacross by the opening and closing of said fluid control valve, said fluid control piston having an axial orifice therein for the passage of water therethrough to said control valve, an orifice pin extending downwardly from said sealing member in axial alignment with said control rod, said orifice pin extending through said orifice in said fluid control piston for reducing the flow of water through said orifice, biasing means disposed about said orifice pin for urging said control valve and said fluid control piston to their respective closed positions, means fixed to said control rod for actuating said control valve, and a drain valve axially translatable into and out of sealing engagement with said supply tank discharge outlet in response to the pressure differentials created by the closing and opening of said control valve.

3. The assembly of claim 2 including an annular "U"-shaped sealing member carried by said fluid control piston at the upper end thereof and adapted to expand outwardly against said valve housing upon the closing of said control valve to prevent water flowing about said fluid control piston, said "U"-shaped sealing member defining an outer diameter greater than the diameter of the lower end of said fluid control piston whereby upon the closing of said fluid control valve said fluid control piston is driven rapidly to its lower sealed position by the differential area forces acting thereon.

4. The assembly of claim 2 wherein said drain valve is at least partially disposed within said housing below said fluid control piston and defines a lift piston thereon disposed within said housing for raising said drain valve out of said sealing engagement in response to the opening of said control valve, said lift piston defining an annular recess in the outer radial end thereof, a plurality of axially disposed aperture in the underside of said lift piston communicating with said recess, and an annular sealing member of finite length carried by said recess and spaced at least partially radially outwardly from said apertures such that upon the opening of said control valve and raising of said fluid control piston, said sealing member is forced radially outwardly against said housing by the resulting pressure differential thereacross, reducing water flow about said piston whereby the upward movement of said drain valve in response to a pressure differential across said lift piston is accelerated.

5. The assembly of claim 4 including an annular "U"-shaped sealing member carried by said fluid control piston at the upper end thereof and adapted to expand outwardly against said valve housing upon the closing of said control valve to prevent water flowing about said fluid control piston, said "U"-shaped sealing member defining an outer diameter greater than the diameter of the lower end of said fluid control piston whereby upon the closing of said fluid control valve said fluid control piston is driven rapidly to its lower sealed position by the differential area forces acting thereon.

6. A flushing assembly adapted to be mounted in a tank of a toilet above the cistern drain, said assembly comprising:

water storage tank having ambient air therein and defining a water discharge outlet;

a valve assembly disposed within said storage tank for opening and closing said discharge outlet;

means for directing water passing through said discharge outlet to the cistern drain to effect a flushing of the toilet;

fluid inlet means for communicating said valve assembly with a supply of pressurized water;

flow outlet means for directing water flow from said valve assembly; and wherein said valve assembly comprises a valve housing, a first fluid flow means for directing water flow from said fluid inlet means to said storage tank to compress the ambient air within a said tank, a second fluid means for directing water flow within said valve assembly to said fluid outlet means, a fluid control valve including a fluid flow passage extending therethrough and communicating with said second fluid flow means, a control rod, a valve seat defined within said housing adjacent said fluid flow passage, a sealing member carried by said control rod, means for biasing said sealing member against said valve seat to prevent fluid flow therethrough, and an actuating member carried by said control rod such that depressing said actuating member compresses said biasing means and moves said sealing member off said valve seat, opening said fluid flow passage and creating a pressure differential within said housing, said valve assembly further comprising a fluid control piston movable within said housing between a lower closed position and an upper position in response to said pressure differential to allow water flow thereby to said second fluid flow means, said biasing means extending between said fluid flow valve and said fluid control piston and urging said flow control piston to said lower closed position, and a cistern drain valve carried by said housing and axially translatable with respect thereto between a lower closed position in sealing engagement with said water discharge outlet and a raised open position in response to the movement of said fluid control piston whereby upon said piston moving to said open position, the air compressed within said storage tank drives the water therein rapidly through said discharge outlet.

7. The assembly of claim 6 including means for actuating said fluid control valve and wherein said fluid control valve includes a fluid flow passage extending therethrough and communicating with said second fluid flow means and a sealing member carried by said actuating means for opening and closing said fluid flow passage in response to activation of said actuating means.

8. The assembly of claims 7 or 6 wherein said fluid control valve includes an orifice pin projecting through said fluid flow passage for limiting the water flow therethrough.

9. The assembly of claims 7 or 6 including a second fluid flow passage communicating with said second fluid flow means and terminating adjacent said fluid control piston whereby said fluid control piston seals said second fluid flow passage in said lower closed position and opens said second fluid flow passage in said upper open position.

10. The assembly of claims 7 or 6 wherein said cistern drain valve defines a lift piston thereon disposed within said housing, said lift piston defining an annular recess in the outer radial end thereof, a plurality of axially disposed apertures in the underside of said lift piston communicating with said recess, and an annular sealing member carried by said recess and spaced radially outwardly from said apertures whereby upon the pressure within said housing about said sealing member dropping below the pressure below said lift piston, said sealing member is forced radially outwardly against said housing, reducing water flow about said lift piston such that the upper movement of said cistern drain valve in response to a pressure drop above said drain valve is accelerated.

11. The assembly of claim 10 wherein said annular sealing member carried by the said lift piston is of a finite length.

12. The assembly of claim 10 wherein said sealing member carried by said lift piston comprises two arcuate portions, each of said portions being of a finite length, defining substantially an inverted "L" in cross section and wherein the ends of each portion are disposed proximate an end of the other portion within said recess.

13. The assembly of claims 7 or 6 wherein said fluid control piston defines an upper end and a lower tapered end and including an annular sealing member carried by said fluid control piston proximate the lower end thereof and an annular "U"-shaped sealing member carried by the upper end of said fluid control piston, the outer diameter of said "U"-shaped sealing member being greater than the diameter across the lower end of said piston whereby the effective area forces acting on said fluid control piston within said housing will force said piston to said lower position prior to the creation of a pressure differential within said housing by said control valve and the hydraulic forces acting on said "U"-shaped sealing member cause said sealing members to expand outwardly against said housing to prevent fluid flow therebetween.

14. The assembly of claim 12 wherein said fluid control piston defines an upper end and a lower tapered end and including an annular sealing member carried by said fluid control piston proximate the lower end thereof and an annular "U"-shaped sealing member carried by the upper end of said fluid control piston, the outer diameter of said "U"-shaped sealing member being greater than the diameter across the lower end of said piston whereby the effective area forces acting on said fluid control piston within said housing will force said piston to said lower position prior to the creation of a pressure differential within said housing by said control valve and the hydraulic forces acting on said "U"-shaped sealing member cause said sealing member to expand outwardly against said housing to prevent fluid flow therebetween.

15. A flushing assembly adapted to be mounted in the tank of a toilet above the cistern drain, said assembly comprising:

a water storage tank having a air of oppositely aligned apertures therein;

means for mounting said storage tank such that one of said apertures is in axial alignment with the cistern drain; and a valve assembly carried by said storage tank and extending through the other of said apertures, said valve assembly having a water inlet adapted to be communicated with a supply of pressurized water and a water outlet and further comprising: a valve housing; a first fluid flow means for directing water flow from said water inlet to said storage tank to compress the ambient air within said tank; a control valve movable in said housing between a closed position and an open position and, upon being moved to said open position, said control valve allowing water flow therethrough and creating a pressure drop with said housing below said control valve; actuating means for moving said control valve to said open position; a fluid control piston axially translatable with said housing below said fluid control valve between a lower closed position and an upper open position, said piston being sized so as to be held in said closed position in the absence of a pressure differential across said piston and move to said open position in response to a pressure drop above said piston, said piston allowing fluid flow thereby in said open position and creating a pressure drop therebelow within said housing upon being moved from said lower to said upper position in response to the opening of said control valve; biasing means disposed between said control valve and said fluid control piston for closing said control valve and said fluid control piston upon water within said housing passing through said control valve and about said piston; a cistern drain valve at least partially disposed within said housing below said fluid control piston and being axially translatable between a lower closed position in sealing engagement with said one aperture in said storage tank and an upper open position, said drain valve defining a first lift piston thereon disposed within said housing for raising said drain valve to said open position in response to a pressure drop above said lift piston, whereupon the compressed air within said storage tank drives water therein through said one aperture in said storage tank to effect flushing of the toilet; and means for closing said cistern drain valve.

16. The assembly of claim 15 wherein said lift piston on said drain valve defines an annual recess in the outer radial end thereof, a plurality of axially disposed apertures in the underside of said lift piston communicating with said recess and an annular sealing member of finite length carried by said recess and spaced radially outwardly from said apertures whereby upon the pressure within said housing about said sealing member dropping below the pressure below said lift piston, said sealing member is forced radially outwardly against housing, reducing water flow about said lift piston whereby the upper movement of said drain valve in response to a pressure drop above said drain valve is accelerated.

17. The assembly of claim 16 wherein said sealing member carried by said lift piston comprises two arcuate portions, each of said portions being of finite length, defining substantially an inverted "L" in cross section and wherein the ends of each portion are disposed proximate an end of the other portion within said recess.

18. The assembly of claim 15 wherein said fluid control piston defines an upper end and a lower tapered end and including an annular sealing member carried by said fluid control piston proximate the lower end thereof and an annular "U"-shaped sealing member carried by the upper end of said fluid control piston, the outer diameter of said "U"-shaped sealing member being greater than the diameter across the lower end of said piston whereby the effective area forces acting on said fluid control piston within said housing will force said piston to said lower position prior to the creation of a pressure differential within said housing by said control valve and the hydraulic forces acting on said "U"-shaped sealing member cause said sealing member to expand outwardly against said housing to prevent fluid flow therebetween.

19. The assembly of claim 15 including an axially disposed first fluid flow passage in said valve housing, a first annular valve seat disposed in said fluid flow passage and means for communicating said first fluid flow passage with said water outlet, and wherein said control valve comprises a control rod extending through said first fluid flow passage and being secured to said actuating means, an annular sealing member carried by said control rod for sealing engagement with said valve seat, and means for biasing said sealing member against said annular valve seat whereby upon depressing said actuating means, said annular sealing member is moved off of said annular valve seat allowing water flow therethrough and creating a pressure drop about said fluid control piston.

20. The assembly of claim 19 including a second valve seat in said fluid flow passage disposed below said fluid control piston, an annular sealing member carried by said fluid control piston proximate the lower end thereof adapted to abut said second valve seat to prevent water flow thereby, and a second flow channel extending axially through said fluid control piston for allowing water flow therethrough to said first valve seat.

21. The assembly of claim 15 wherein said fluid control piston defines an axially disposed chamber therein terminating in a reduced diameter orifice extending through the lower end of said piston, and said fluid control valve comprises: a guide member secured in the upper end of said valve housing, said guide member defining an axial channel extending therethrough, fluid passage means communicating said channel with said water outlet in said valve assembly and a valve seat disposed about the lower end of said axially channel; a control rod extending through said channel in said member, an annular sealing member carried by said control rod and adapted to abut said valve seat in said guide member for sealing said axially channel; an orifice pin carried by said control rod in axial alignment therewith and extending through said orifice of said fluid control piston; and a spring member disposed about said orifice and extending between a portion of said control rod and said fluid control piston for biasing said annular sealing member carried by said control rod against valve seat and said fluid control piston to said closed position.

22. A flushing assembly adapted to be mounted in the tank of a toilet above the tank drain, said assembly comprising:

a water storage tank having ambient air therein and defining a water discharge outlet;

means for directing water passing through said discharge outlet to the tank drain to effect a flushing of the toilet bowl;

a valve assembly disposed within said storage tank in axial alignment with said water discharge outlet for opening and closing said discharge outlet; and wherein said valve assembly comprises a first fluid flow means for directing water from said fluid inlet means into said storage tank to comprise the ambient air within said storage tank, a second fluid flow means for directing water from said valve assembly to said fluid outlet means, a control valve including a control rod and a sealing member carried by said rod for closing and opening said second fluid flow means for selective passage of water therethrough to create and relieve a pressure drop below said control valve, a fluid flow piston axially translatable within said housing below and independently of said control valve between a lower closed position preventing water flow to said second fluid flow means and an upper open position allowing water flow about said piston to said second fluid flow means in response to pressure differentials created thereacross by the opening and closing of said control valve, and a drain valve axially translatable below and independently of said fluid control piston into and out of sealing engagement with said supply tank discharge outlet in response to the pressure differentials created by the axial movement of said piston between said closed and open positions.

23. The assembly of claim 22 including a valve housing disposed about said control valve and said fluid control piston and terminating in a depending tubular extension, and wherein said drain valve includes a lift piston thereon disposed within said tubular extension for raising said drain valve out of said sealing engagement with said supply tank discharged outlet in response to the movement of said fluid control piston to said open position.

24. The assembly of claim 23 wherein said lift piston defines an annular recess in the outer radial end thereof, a plurality of axially disposed apertures in the underside of said lift piston communicating with said recess, and an annular sealing member of finite length carried by said recess and spaced at least partially radially outwardly from said apertures such that upon the opening of said control valve and raising of said fluid control piston, said sealing member is forced radially outwardly against said tubular extension by the resulting pressure differential thereacross, thereby reducing water flow about said piston whereby the upward movement of said drain valve in response to a pressure differential across said lift piston is accelerated.

25. The assemblies of claim 22, 23 or 24 including an annular "U"-shaped sealing member carried by said fluid control piston at the upper end thereof and adapted to expand outwardly against said valve housing upon the closing of said control valve to prevent water flowing about said fluid control piston, said "U"-shaped sealing member defining an outer diameter greater than the diameter of the lower end of said fluid control piston whereby upon the closing of said fluid control valve, said fluid control piston is driven rapidly to its lower closed position by the differential area forces acting thereon.

26. A flushing assembly adapted to be mounted in the tank of a toilet above the tank drain, said assembly comprising:

a water storage tank having ambient air therein and defining a water discharge outlet;

means for directing water passing through said discharge outlet to the tank drain to effect a flushing of the toilet bowl;

a valve assembly disposed within said storage tank for opening and closing said discharge outlet;

fluid inlet means for communicating said valve assembly with a supply of pressurized water;

fluid outlet means for communicating said valve assembly with the tank drain; and wherein said valve assembly comprises: a valve housing disposed within said storage tank in axial alignment with said water discharge opening and defining a tubular extension at the lower end thereof; a first valve means disposed within said housing and movable between a closed and an open position for selective passage of fluid flow therethrough to said fluid outlet means to create and relieve a first pressure drop within said housing below said valve means upon the opening and closing thereof; means for opening first valve means; a second valve means axially movable within said housing and independently of first valve means between a closed position and an open position in response to the creation and relief of said first pressure drop to selectively allow fluid flow to said fluid outlet means and thereby create and relieve a second pressure drop within said housing below said second valve means; biasing means disposed between said first and second valve means for urging said first and second valve means to their respective closed positions; and a third valve means axially movable independently of said first and second valve means into and out sealing engagement with said supply tank discharge outlet in response to the creation and relief of said second pressure drop by said second valve means, said third valve means being axially aligned with said second valve means and said water discharge outlet and defining a lift piston thereon disposed within said housing for rapidly raising said third valve means out of sealing engagement with said discharge outlet in response to the creation of said second pressure drop.

27. The assembly of claim 26 including sealing means carried by said lift piston and means for forcing said sealing means outwardly against said tubular extension in response to said second pressure drop, thereby reducing water flow about said lift piston whereby the upward movement of said third valve means in response to said second pressure drop is accelerated.

28. A flushing assembly adapted to be mounted in the tank of a toilet above the tank drain, said assembly comprising:

a water storage tank having ambient air therein and defining a water discharge outlet;

means for directing water passing through said discharge outlet to the tank drain to effect a flushing of the toilet bowl;

a valve assembly disposed within said storage tank for opening and closing said discharge outlet;

a fluid inlet means for communicating said valve assembly with a supply of pressurized water;

fluid outlet means for communicating said valve assembly with the tank drain; and wherein said valve assembly comprises: a valve housing disposed within said storage tank in axial alignment with said water discharge outlet; a first fluid flow means for directing water from said fluid inlet means into said storage tank to compress the ambient air within said storage tank; a second fluid flow means for directing water from said valve assembly to said fluid outlet means; a third fluid flow means for directing water from said valve assembly to said fluid outlet means; a control valve for opening and closing said second fluid flow means for selective passage of water therethrough to create and relieve a first pressure drop within said housing below said control valve; a fluid control piston axially translatable within said housing below said control valve between a closed piston and an open position in response to the creation and relief of said first pressure drop to selectively allow fluid flow to said third fluid flow means and thereby create and relieve a second pressure drop within said housing below said piston, and a drain valve at least partially disposed within said housing and axially translatable below and independently of said piston into and out of sealing engagement with said water discharge outlet in response to the creation and discharge of said second pressure drop by said piston.

29. The assembly of claim 28 wherein said piston defines an axially disposed fluid passageway therein for the passage of water therethrough to said control valve and including biasing means disposed in said passageway and extending between said control valve and said piston for urging said control valve and piston to their respective closed positions.

30. The assembly of claim 29 wherein said valve housing defines a depending tubular extension and wherein said drain valve defines a lift piston thereon disposed within said tubular extension for raising said drain valve out of said sealing engagement with said water discharge outlet in response to the creation of said second pressure drop by said control piston.

31. A valve assembly for use in a toilet flushing mechanism in combination with fluid inlet means for communicating the valve assembly with a supply of pressurized water, fluid outlet means for communicating the valve assembly with the toilet tank drain and a water storage tank having ambient air therein which is secured within the toilet tank above the toilet tank drain and defines a water discharge outlet in the lower end thereof axially aligned with the toilet tank drain and an opening in the upper end thereof axially aligned with the water discharge outlet and adapted to receive the valve assembly, said valve assembly comprising:

a valve housing, a first fluid flow means disposed in said housing for directing water from the fluid inlet means into the storage tank to compress the ambient air within the storage tank, a second fluid flow means disposed in said housing for directing water from said valve assembly to the fluid outlet means, a control valve disposed within said housing and including a control rod and a sealing member carried by said rod and movable between a closed and open position for opening and closing said second fluid flow means for selective passage of water therethrough to create and relieve a pressure drop below said control valve, a third fluid flow means disposed within said housing below said second fluid flow means for directing water from said valve assembly to the fluid outlet means, a fluid control piston axially translatable within said housing below said fluid control valve between a lower closed position preventing water flow to said third fluid flow means and an upper open position allowing water flow about said piston to said third fluid flow means in response to pressure differentials created thereacross by the opening and closing of said fluid control valves, said fluid control piston having an axial orifice therein for the passage of water therethrough to said control valve, an orifice pin extending downwardly from said sealing member in axial alignment with aid control rod, said orifice pin extending through said orifice in said fluid control piston for reducing the flow of water through said orifice, a biasing means disposed about said orifice pin for urging said control valve and said fluid control piston to their respective closed positions, means fixed to said control rod for actuating said control valve and a drain valve axially translatable into and out of sealing engagement with the water discharge outlet in response to the pressure differentials created by the closing and opening of said control valve.

32. A valve assembly for use in a toilet flushing mechanism in combination with fluid inlet means for communicating the valve assembly with a supply of pressurized water, fluid outlet means for communicating the valve assembly with the toilet tank drain and a water storage having ambient air therein which is secured within the toilet tank above the toilet tank drain and defines a water discharge outlet in the lower end thereof axially aligned with the toilet tank drain and an opening in the upper end thereof axially aligned with the water discharge outlet and adapted to receive the valve assembly, said valve assembly comprising:

a valve housing, a first fluid control means for directing water flow from the fluid inlet means to the storage tank to compress the ambient air within the storage tank, a second fluid flow means for directing water flow within said valve assembly to the fluid outlet means, a fluid control valve including a fluid flow passage extending therethrough and communicating with said second fluid flow means, a control rod, a valve seat defined within said housing adjacent said fluid flow passage, a sealing member carried by said control rod, means for biasing said sealing member against said valve seat to prevent fluid flow therethrough, and an actuating member carried by said control rod such that depressing said actuating member compresses said biasing means and moves said sealing member off said valve seat, opening said fluid flow passage and creating a pressure differential within said housing, said valve assembly further comprising a fluid control piston movable within said housing between a lower closed position and an upper position in response to said pressure differential to allow water flow thereby to said second fluid control means, said biasing means extending between said fluid flow valve and said fluid control piston and urging said fluid control piston to said lower closed position and a cistern drain valve carried by said housing and axially translatable with respect thereto between a lower closed position in sealing engagement with the water discharge outlet and a raised open position in response to the movement of said fluid control piston whereby upon said piston moving to said open position, the compressed air within the storage tank drives the water therein rapidly through the discharge outlet.

33. A valve assembly for use in a toilet flushing mechanism in combination with fluid inlet means for communicating the valve assembly with a supply of pressurized water, fluid outlet means for communicating the valve assembly with the toilet tank drain and a water storage tank having ambient air therein which is secured within the toilet tank above the toilet tank drain and defines a water discharge outlet in the lower end thereof axially aligned with the toilet tank drain and an opening in the upper end thereof axially aligned with the water discharge outlet and adapted to receive the valve assembly, said valve assembly comprising:

a first fluid flow means for directing water from the fluid inlet means into the water storage tank to compress the ambient air within the storage tank, a second fluid flow means for directing water from said valve assembly to the fluid outlet means, a control valve including a control rod and a sealing member carried by said rod for closing and opening said fluid flow means for selective passage of water therethrough to create and relieve a pressure drop below said control valve, a fluid flow piston axially translatable within said housing below and independently of said control valve between a lower closed position preventing water flow to said second fluid means and an upper open position allowing water flow about said piston to said second fluid flow means in response to pressure differentials created thereacross by the opening and closing of said control valve, and a drain valve axially translatable below and independently of said fluid control piston into and out of sealing engagement with the storage tank discharge outlet in response to the pressure differentials created by the axial movement of said piston between said closed and open positions.

34. A valve assembly for use in a toilet flushing mechanism in combination with fluid inlet means for communicating the valve assembly with a supply of pressurized water, fluid outlet means for communicating the valve assembly with the toilet tank drain and a water storage tank having ambient air therein which is secured within the toilet tank above the toilet tank drain and defines a water discharge outlet in the lower end thereof axially aligned with the toilet tank drain and an opening in the upper end thereof axially aligned with the water discharge outlet and adapted to receive the valve assembly, said valve assembly comprising:

a valve housing adapted to be disposed within the water storage tank in axial alignment with the water discharge outlet, a first fluid flow means for directing water from the fluid inlet means into the storage tank to compress ambient air within the storage tank, a second fluid flow means directing water from said valve assembly to the fluid outlet means, a third fluid flow means for directing water to said valve assembly to the fluid outlet means, a control valve for opening and closing said second fluid flow means for selective passage of water therethrough to create and relieve a pressure drop within said housing below said control valve, a control piston axially translatable within said housing below said control valve between a closed position and an open position in response to the creation and relieve of said first pressure drop to selectively allow fluid flow to said third fluid flow means and thereby create and relieve a second pressure drop within said housing below said piston, and a drain valve at least partially disposed within said housing and axially translatable below and independently of said piston into and out of sealing engagement with said water discharge outlet in response to the creation and discharge of the said second pressure drop by said piston.

35. The valve assemblies of claims 33 or 34 wherein said piston defines an axially disposed fluid passageway therein for the passage of water therethrough to said control valve and including biasing means disposed in said passageway and extending between said control valve and piston for urging said control valve and piston to their respective closed positions.

36. A flushing assembly adapted to be mounted in the tank of a toilet above the tank drain, said assembly comprising:

a water storage tank having ambient air therein and defining an upper end, a lower end and a water discharge outlet in said lower end;

means for directing water passing through said discharge outlet to the tank drain to effect a flushing of the toilet bowl;

a valve assembly disposed within said storage tank for opening and closing said discharge outlet;

a fluid inlet means for communicating said valve assembly with a supply of pressurized water;

fluid outlet means for communicating said valve assembly with the tank drain; and wherein said valve assembly comprises a valve housing disposed within said storage tank in axial alignment with said water discharge outlet, a first fluid flow means for directing water from said fluid inlet means into said storage tank to compress the ambient air within said storage tank, a second fluid flow means for directing water from said valve assembly to said fluid outlet means, a control valve movable between a closed position and an open position and including a control rod, a sealing member carried by said rod, and means for biasing said control valve to said closed position, said control valve providing selective passage of water therethrough to create and relieve a pressure drop within said housing, a fluid flow piston axially translatable within said housing between a lower closed position preventing water flow to said second fluid flow means and an upper open position allowing water flow about said piston to said fluid flow means in response to pressure differentials created thereacross by the opening and closing of said control valve, and a drain valve axially translatable below and independently of said fluid control piston into and out of sealing engagement with said water discharge outlet in said storage tank in response to pressure differentials created within said housing by the axial movement of said piston between said closed and open positions.

37. The assembly of claim 36 wherein said valve housing terminates in a dependent tubular extension and wherein said drain valve includes a lift piston thereon disposed within said tubular extension for raising said drain valve out of sealing engagement with said supply tank discharge outlet in response to the movement of said fluid control piston to said open position.

38. The assembly of claim 37 wherein said lift piston defines an annular recess in an outer radial end thereof, a plurality of axially disposed apertures in the underside of said lift piston communicating with said recess, and an annular sealing member of finite length carried by said recess and spaced at least partially radially outwardly from said apertures such that upon the opening of said control valve and raising of said fluid control piston, said sealing member is forced radially outwardly against said tubular extension by the resulting pressure differential thereacross, thereby reducing water flow about said piston whereby the upward movement of said drain valve in response to a pressure differential across said lift piston is accelerated.

39. The assemblies of claims 36, 37, or 38, including an annular "U"-shaped sealing member carried by said fluid control piston at the upper end thereof and adapted to expand outwardly against said valve housing upon the closing of said control valve to prevent water flowing about said fluid control piston, said "U"-shaped sealing member defining an outer diameter greater than the diameter of the lower end of said fluid control piston whereby upon the closing of said fluid control valve, said fluid control piston is driven rapidly to its lower closed position by the differential area forces acting thereon.

40. A flushing assembly adapted to be mounted in the tank of a toilet above the tank drain, said assembly comprising:

a water storage tank having ambient air therein and defining a water discharge outlet;

means for directing water passing through said discharge outlet to the tank drain to effect a flushing of the toilet bowl;

a valve assembly disposed within said storage tank for opening and closing said discharge outlet;

a fluid inlet means for communicating said valve assembly with a supply of pressurized water;

fluid outlet means for communicating said valve assembly with the tank drain; and wherein said valve assembly comprises a valve housing disposed within said storage tank in axial alignment with said water discharge outlet, a control valve operative between a closed position and an open position for the selective passage of water therethrough to create and relieve a first pressure drop within said housing, a first fluid flow means for directing water from said fluid inlet means into said storage tank to compress the ambient air within said storage tank, a second fluid flow means for directing water from said valve assembly to said fluid outlet means, a third fluid flow means for directing water from said valve assembly to said fluid outlet means, a fluid control piston axially translatable within said housing between a closed position and an open position in response to the creation and relief of said first pressure drop to selectively allow fluid flow to said third fluid flow means and thereby create and relieve a second pressure drop within said housing below said piston, and a drain valve at least partially disposed within said housing, axially aligned with said piston and said water discharge outlet and translatable below and independently of said piston into and out of sealing engagement with said water discharge outlet in response to the creation and discharge of said second pressure drop by said piston.

41. The assembly of claim 40 wherein said piston defines an axially disposed fluid passageway therein for the passage of water therethrough to said control valve and including biasing means for urging said control valve to a closed position.

42. The assembly of claim 41 wherein said valve housing defines a depending tubular extension and wherein said drain valve defines a lift piston thereon disposed within said tubular extension for raising said drain valve out of said sealing engagement with said water discharge outlet in response to the creation of said second pressure drop by said control piston.

43. A valve assembly for use in a toilet flushing mechanism in combination with fluid inlet means for communicating the valve assembly with a supply of pressurized water, fluid outlet means for communicating the valve assembly with the toilet tank drain and a water storage tank having ambient air therein which is secured within the toilet tank above the toilet tank drain and defines a water discharge outlet in the lower end thereof axially aligned with the toilet tank drain and an opening in the upper end thereof axially aligned with the water discharge outlet and adapted to receive the valve assembly, said valve assembly comprising:

a valve housing, a first fluid flow means for directing water from the fluid flow inlet means into the storage tank to compress the ambient air within the storage tank, a second fluid flow means for directing water from said valve assembly to the fluid outlet means, a control valve movable between a closed position and an open position and including a control rod, a sealing member carried by said rod, and means for biasing said control valve to said closed position, said control valve providing selective passage of water therethrough to create and relieve a pressure drop within said housing, a fluid flow piston axially translatable within said housing, independently of said control valve between a lower closed position preventing water flow to said second fluid flow means and an upper open position allowing water flow about said piston to said fluid flow means in response to pressure differentials created thereacross by the opening and closing of said control valve, and a drain valve axially translatable below and independently of said fluid control piston into and out of sealing engagement with the discharge outlet in the water storage tank in response to pressure differentials created within said housing by the axial movement of said piston between said closed and open positions.

* * * * *